United States Patent [19]

Seven

[11] 4,451,086

[45] May 29, 1984

[54] SEAT FOR A CHAIR FOR PERSONS HAVING HIP AND/OR LEG STIFFNESS

[75] Inventor: Regnell Seven, Vastervik, Sweden

[73] Assignee: Mercado Rehabilitering AB, Stockholm, Sweden

[21] Appl. No.: 247,305

[22] PCT Filed: Jul. 29, 1980

[86] PCT No.: PCT/SE80/00195

§ 371 Date: Mar. 25, 1981

§ 102(e) Date: Mar. 25, 1981

[87] PCT Pub. No.: WO81/00350

PCT Pub. Date: Feb. 19, 1981

[30] Foreign Application Priority Data

Aug. 1, 1979 [SE] Sweden ..... 7906532

[51] Int. Cl.[3] ..... A47C 1/00; A47C 7/02

[52] U.S. Cl. ..... 297/312; 297/201

[58] Field of Search ..... 297/312, 201, 284, 313

[56] References Cited

U.S. PATENT DOCUMENTS

| | | | |
|---|---|---|---|
| 2,132,331 | 10/1938 | Wanamaker | 297/313 X |
| 2,638,290 | 5/1953 | Lecarme | 297/312 |
| 2,799,323 | 7/1957 | Berg | 297/312 |
| 3,446,532 | 5/1969 | Cramer | 297/312 |
| 3,773,382 | 11/1973 | Coursault et al. | 297/284 |
| 3,885,173 | 5/1975 | Shephard et al. | 297/312 |
| 3,989,297 | 11/1976 | Kerstholf | 297/312 |

FOREIGN PATENT DOCUMENTS

| | | | |
|---|---|---|---|
| 2019141 | 4/1970 | Fed. Rep. of Germany | 297/284 |
| 2905065 | 8/1978 | Fed. Rep. of Germany | 297/201 |
| 360232 | 2/1906 | France | 297/201 |

*Primary Examiner*—Francis K. Zugel

*Attorney, Agent, or Firm*—Wigman & Cohen

[57] ABSTRACT

The invention relates to a seat for a chair for persons having hip and/or leg stiffness, the seat including at least one pivotable portion (1, 2) pivoting around a pivot axis (3) extending in the lateral direction of the seat, the forward edge of each pivotable portion forming part of the front edge of the seat, whereby each pivotable portion (1, 2) is arranged for pivoting movement between a substantially horizontal position and a position where it is directed forwardly and downwardly, a locking device (5) being arranged for locking each pivotable portions (1, 2) in the desired position. The object of the invention is to improve a seat of this kind, so that a person having hip and/or leg stiffness may have a better sitting position than is possible in previously known seats of this kind. This is achieved according to the invention in that each pivotable portion (1, 2) extends over substantially the full sitting depth of the seat, and in that the pivot axis (3) is positioned at a distance from the front edge of the seat corresponding to at least half the sitting depth.

1 Claim, 1 Drawing Figure

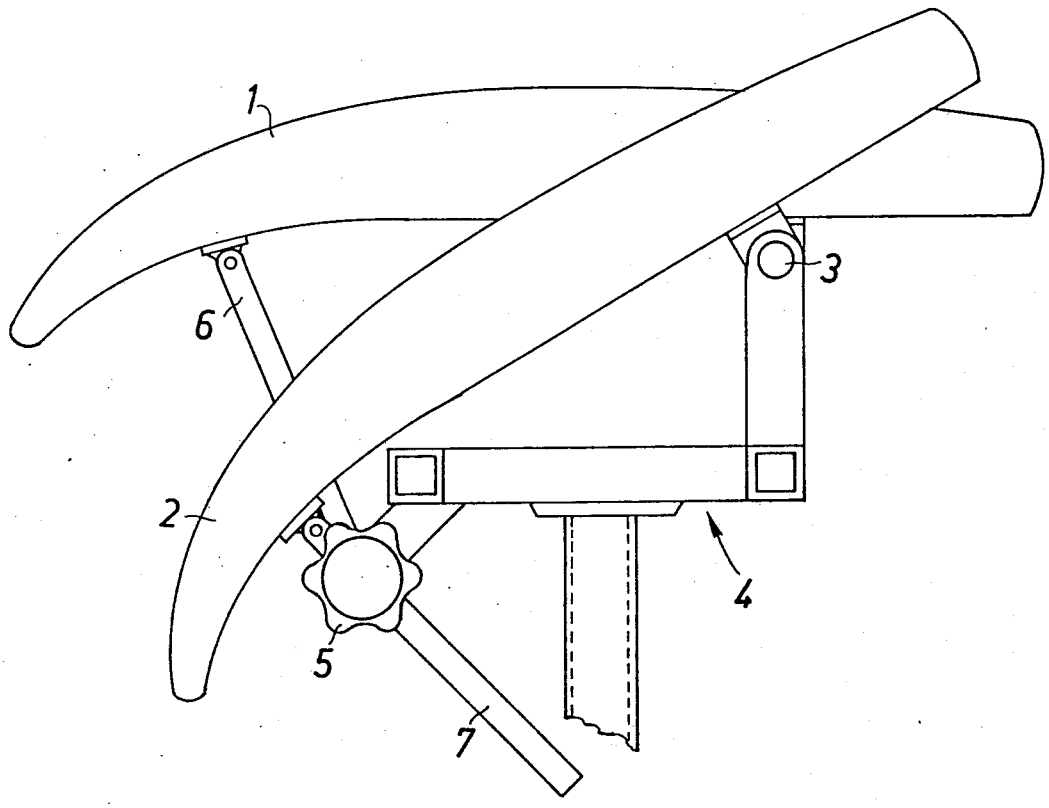
1
2
3
4
5
6
7

SEAT FOR A CHAIR FOR PERSONS HAVING HIP AND/OR LEG STIFFNESS

BACKGROUND OF THE INVENTION

1. Field of the Invention

The present invention relates to a seat for a chair for persons having hip and/or leg stiffness, said seat including at least one pivotable portion pivoting around a pivot axis extending in the lateral direction of the seat, the forward edge of each pivotable portion forming part of the front edge of the seat, whereby each pivotable portion is arranged for pivoting movement between a substantially horizontal position and a position where it is directed forwardly and downwardly, a locking device being arranged for locking each pivotable portion in the desired position.

2. Description of the Prior Art

For persons having hip and/or leg stiffness, chairs have previously been used, said chairs having the seat divided in three portions, i.e. a rear, fixed portion and two pivoting front portions, arranged side by side, said pivotable portions being mounted to the rear portion by means of hinges and being provided with locking devices for locking in the desired position. However, seats of this type are not completely satisfactory. The reason is that they do not give the best possible sitting position according to the circumstances, because they cannot give sufficient support for a stiff leg and/or hip. This means that a person having hip and/or leg stiffness must sit twisted in the longitudinal direction in order to completely use the pivotable portions, which of course is unsatisfactory.

SUMMARY AND OBJECT OF INVENTION

The object of the present invention is to remove these disadvantages and to provide a seat of the type mentioned, said seat making it possible for a person having hip and/or leg stiffness to sit straight ahead on the chair having completely satisfactory support. According to the invention, this is achieved in that each pivotable portion extends over substantially the full sitting depth of the seat, and in that the pivot axis is positioned at a distance from the front edge of the seat corresponding to at least half the sitting depth.

BRIEF DESCRIPTION OF THE DRAWING

The invention will be described in more detail below with reference to the accompanying drawing, which shows a schematical side view of a seat according to one embodiment of the invention with one pivotable portion in the horizontal position and the other pivotable portion directed forwardly and downwardly.

DETAILED DESCRIPTION OF THE PREFERRED EMBODIMENT

The seat shown in the drawing includes two independent, pivotable portions 1 and 2, the portion 1 being shown in its upper, substantially horizontal position, and the portion 2 being shown in its downwardly directed position. The pivotable portions 1 and 2 are mounted for pivotal movement around a pivot axis or shaft 3, which is arranged at a distance from the front edge of the seat corresponding to approximately $\frac{3}{4}$ of the sitting depth. The pivot shaft 3 is supported by a frame 4, which is provided with mounting means enabling mounting of the frame on the base of any chair (not shown in detail), which may be of standard type.

The frame 4 also carries a locking device 5 for each pivotable portion 1, 2, and the locking device 5 is arranged to slidingly cooperate with support means 6 and 7, respectively, which are connected to the pivotable portion 1 and 2, respectively, adjacent its forward edge, in order to enable locking of the pivotable portions 1 and 2 in the desired position.

In the drawing, the pivotable portion 2 is shown pivoted downwardly around the pivot shaft 3, and, as is clear from the drawing, this pivoting movement means that the portion positioned behind the pivot shaft 3 extends upwardly above the substantially horizontal portion 1 and gives completely satisfactory support for the hip of the person having hip and/or leg stiffness sitting on the seat. In the embodiment of the invention shown in the drawing, the pivot shaft 3 is positioned at a distance from the front edge of the seat corresponding to approximately $\frac{3}{4}$ of the sitting depth, but by adjusting it to a different position of the pivot shaft, the size of the upwardly extending portion may of course be changed, if this should be desired.

Another important advantage of the seat according to the invention is that it may also be used as a so called pivot seat, i.e. a person having difficulties sitting on a horizontal seat may pivot the whole seat downwardly to the angle required for achieving a comfortable sitting position according to the circumstances. Further, the chair may also be used as an ordinary chair with both pivotable portions 1 and 2 being arranged in horizontal position.

The invention is not limited to the embodiment described above, but changes may be made within the scope of the accompanying claims.

I claim:

1. Seat for a chair for persons having hip and/or leg stiffness, said seat including at least two pivotable portions pivoting around a pivot axis extending in the lateral direction of the seat, the forward edge of each pivotable portion forming part of the front edge of the seat, whereby each pivotable portion is arranged for pivoting movement between a substantially horizontal position and a position where it is directed forwardly and downwardly, a locking device being arranged for locking each pivotable portion in the desired position, characterized in that:

- each pivotable portion extends over substantially the full sitting depth of the seat,
- the pivot axis is positioned at a distance from the front edge of the seat corresponding to approximately three-fourths of the sitting depth,
- each pivotable portion in its front portion is supported by a support means, which is pivotally connected to the pivotable portion at one end and is arranged to slidingly cooperate with the locking device at its other end, and
- each locking device is mounted on a frame, which also carries the pivot axis and which is provided with mounting means enabling mounting of the frame on the base of any standard type chair,
- wherein each pivotable portion may be locked or unlocked independently of other pivotable portions.

* * * * *